US006248029B1

(12) United States Patent
Maruko

(10) Patent No.: US 6,248,029 B1
(45) Date of Patent: Jun. 19, 2001

(54) SOLID GOLF BALL

(75) Inventor: Takashi Maruko, Chichibu (JP)

(73) Assignee: Bridge Sports Co., Ltd., Tokyo (JP)

( * ) Notice: Subject to any disclaimer, the term of this patent is extended or adjusted under 35 U.S.C. 154(b) by 0 days.

(21) Appl. No.: 09/188,890

(22) Filed: Nov. 10, 1998

(30) Foreign Application Priority Data

Nov. 20, 1997 (JP) ..... 9-336433

(51) Int. Cl.[7] ..... A63B 37/06
(52) U.S. Cl. ..... 473/374; 473/376
(58) Field of Search ..... 473/374, 373, 473/376

(56) References Cited

U.S. PATENT DOCUMENTS 4,863,167 * 9/1989 Matsuki et al. ..... 473/374 X
5,779,562 * 7/1998 Melvin et al. ..... 473/373

FOREIGN PATENT DOCUMENTS 6-23069 2/1994 (JP) .
6-170012 6/1994 (JP) .

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

A solid golf ball comprises a solid core (1) and a cover (2). The solid core (1) has a multilayer construction with a core inner layer (3) and a core outer layer (4). The core inner layer has a diameter of 15–22 mm and a Shore D hardness of 40–70. It has a specific gravity from 1.10 to 1.65. The core outer layer has a JIS-C hardness of 40–75. It has a specific gravity of 1.05 to 1.25. The core inner and outer layers are formed of polybutadiene base rubber compositions. The specific gravity of the core inner layer is greater than the specific gravity of the core outer layer. The cover has a gage of 0.5–3 mm. The ball provides an increased carry when hit by a low head speed player, as well as better feel.

12 Claims, 1 Drawing Sheet

SOLID GOLF BALL

This invention relates to a solid golf ball suitable for golfers having a relatively low club head speed of less than 40 m/s.

BACKGROUND OF THE INVENTION

Numerous attempts have been made to achieve golf balls endowed with both increased carry and a good feel when hit. The approach most commonly taken in solid golf balls has been to alter the hardnesses of the cover and the core.

Solid golf balls having a multilayer solid core with a core inner layer and a core outer layer have recently been proposed. For example, JP-A 23069/1994 discloses a solid golf ball having a three-layer construction comprising a core, a core outer layer, and a cover wherein the core has a diameter of 23 to 35 mm and a Shore D hardness of 30 to 62 The core outer layer has a Shore D hardness of 30 to 56 whereby a suitable spin is maintained and the rebound characteristics and carry are improved. However, when this solid golf ball is hit at a relatively low head speed of about 35 m/s, the ball is given a low initial velocity, failing to have sufficient carry.

JP-A 170012/1994 describes a solid golf ball in which the core inner layer is made of Surlyn ionomer resin, commonly used as a cover material, that has been foamed ($\rho$=0.2 to 1.0). Yet, the core inner layer is so soft that the ball provides a poor rebound and an inadequate carry.

Because most conventional golf balls are targeted at professional golfers and skilled amateurs, they have been designed for optimal performance in a relatively club high head speed range of about 40 to 45 m/s. But these golf balls are often less than ideal for use by relatively low club head speed players such as women golfers and seniors who strike the ball at club head speeds of less than 40 m/s. If a low club head speed golfer plays a full shot with a driver, for instance, the speed upon impact (initial velocity) conventional balls acquire will be too low to provide an adequate carry.

SUMMARY OF THE INVENTION

An object of the present invention is to provide a golf ball which is suitable for use by players having a relatively low head speed of under 40 m/s, affording in particular a good carry when hit with a driver, and which also has a good feel.

The present invention provides a solid golf ball comprising a solid core and a cover enclosing the solid core. The solid core has a multilayer construction consisting essentially of a core inner layer and a core outer layer enclosing the core inner layer. The core inner layer has a diameter of 15 to 22 mm and a Shore D hardness of 40 to 70, and the core outer layer has a JIS-C hardness of 40 to 75. Each of the core inner layer and the core outer layer is formed of a polybutadiene base rubber composition. The cover has a gage of 0.5 to 3 mm. Preferably, the core inner layer has a specific gravity of 1.1 to 1.65, and the core outer layer has a specific gravity of 1.05 to 1.25. Also preferably, the solid golf ball undergoes a deformation of 2.4 to 3.8 mm under a load of 100 kg.

The golf ball of this construction is suitable for use by players having a relatively low club head speed of under 40 m/s. More particularly, the relatively hard core inner layer having a relatively small diameter cooperates with the soft core outer layer having high resilience so that the ball may be sufficiently deformed when a player having a relatively low club head speed of under 40 m/s plays a full shot with a driver. As a result, the initial velocity is increased to insure an outstandingly increased carry and the feel is also improved.

It is noted that JP-A 23069/1994 discloses a golf ball wherein the core inner layer and the core outer layer are formed of polybutadiene base rubber compositions as in the present invention. The core inner layer has a diameter as large as 23 to 35 mm. As seen from Example describing that the golf ball exhibits excellent flight performance when hit at a very high head speed of 108 MPH (=48.3 m/s), this golf ball is designed optimum for very high club head speed players, typically professional golfers, but not suitable for players who swing at a relatively low club head speed of under 40 m/s.

BRIEF DESCRIPTION OF THE DRAWING

The only FIGURE.

DETAILED DESCRIPTION OF THE INVENTION

Figure 1:
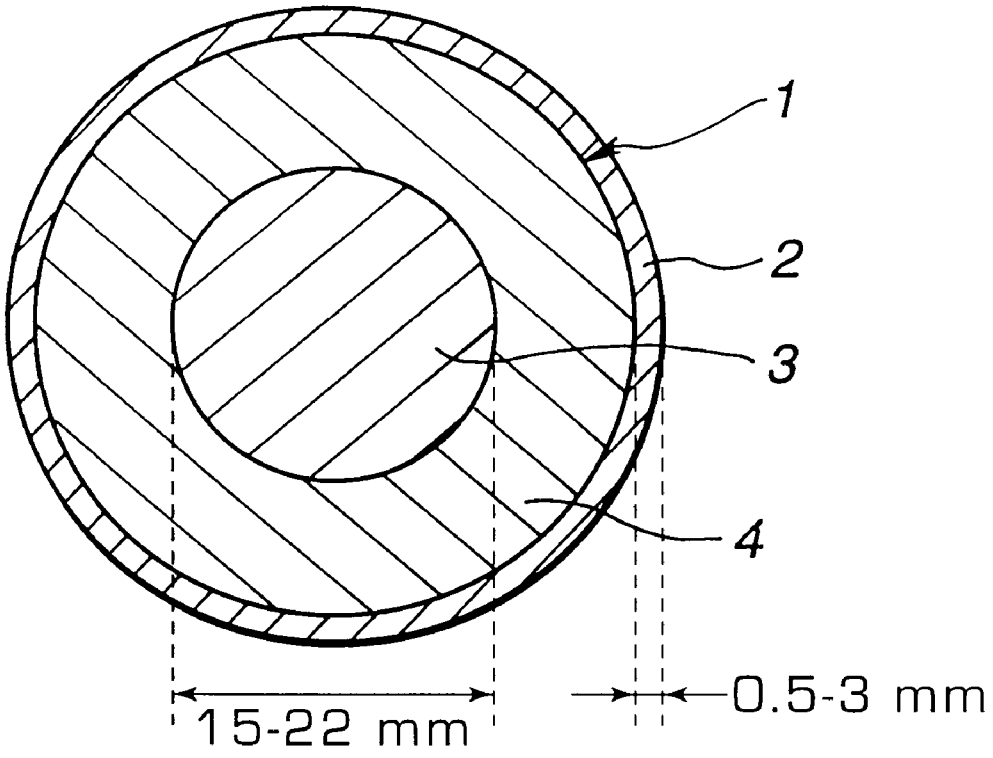
FIG. 1 is a sectional view of a solid golf ball according to one embodiment of the present invention.

Referring to FIG. 1, the solid golf ball of the present invention comprises a solid core 1 and a cover 2 which encloses the solid core 1. The solid core 1 has a two-layer construction consisting of a core inner layer 3 serving as a center sphere and a core outer layer 4 which encloses the surface of the core inner layer 3. About the solid core 1 is formed a single layer cover 2. Although the solid golf ball shown in FIG. 1 has a solid core 1 formed of two layers and a cover 2 formed of one layer, the cover may have a multilayer construction with two, three or more layers if necessary. Moreover, within the scope allowed by the above provisions, one or both of the core inner layer and the core outer layer may have a multilayer construction.

Both the core inner and outer layers 3 and 4 of the solid core 1 are made of polybutadiene base rubber compositions which are commonly used in prior art golf ball cores.

The use of cis-1,4-polybutadiene having at least 40% of a cis structure is especially suitable. Where desired, natural rubber, polyisoprene rubber, styrene-butadiene rubber or the like may be suitably compounded in the base rubber. However, because a higher proportion of polybutadiene increases the rebound characteristics of the golf ball, these other ingredients should preferably be compounded in an amount of not more than 10 parts by weight per 100 parts by weight of the polybutadiene.

A crosslinking agent may be blended into the rubber composition. Examples include the zinc salts and magnesium salts of unsaturated fatty acids, such as zinc methacrylate and zinc acrylate, and ester compounds such as trimethyl-propane methacrylate. Of these, the use of zinc acrylate is especially preferred because of the high resilience this provides. The crosslinking agents are preferably compounded in amounts of from about 10 to 30 parts by weight for the core outer layer and from about 25 to 45 parts by weight for the core inner layer, both per 100 parts by weight of the base rubber.

A vulcanizing agent is often compounded within the rubber composition. It is recommended that the vulcanizing agent contain a peroxide having a 1-minute half-life temperature of not more than 155° C., the amount of the peroxide being at least 30% by weight, and especially 40 to 70% by weight, of the overall amount of vulcanizing agent. Suitable peroxides include commercially available products such as Perhexa 3M (manufactured by Nippon Oils and Fats K.K.). The amount of vulcanizing agent blended into the rubber composition may be set at preferably from 0.1 to 5 parts by weight per 100 parts by weight of the base rubber.

Other suitable ingredients may also be compounded into the rubber composition, including antioxidants, and fillers such as zinc oxide and barium sulfate for adjusting the specific gravity. The specific gravity modifiers are preferably blended in amounts of from 5 to 130 parts by weight per 100 parts by weight of the base rubber.

In the golf ball of the invention, the core inner layer is formed harder than the core outer layer. The hardness difference can be accomplished by changing the amount of crosslinking agent such as zinc acrylate, the amount of vulcanizing agent, and the amount of inorganic filler in the rubber composition or by suitably selecting vulcanizing conditions including temperature and time.

One exemplary preferred example of the rubber composition for the core inner layer is shown below.

| Ingredients | Parts by weight |
|---|---|
| Cis-1,4-polybutadiene | 100 |
| Zinc oxide | 5 to 116 |
| Zinc acrylate | 25 to 45 |
| Barium sulfate | 0 to 124 |
| Peroxide | 0.1 to 5.0 |

Vulcanizing conditions: 150 ± 10° C., 5 to 20 minutes

One exemplary preferred example of the rubber composition for the core outer layer is shown below.

| Ingredients | Parts by weight |
|---|---|
| Cis-1,4-polybutadiene | 100 |
| Zinc oxide | 5 to 45 |
| Zinc acrylate | 10 to 30 |
| Barium sulfate | 0 to 44 |
| Peroxide | 0.1 to 5.0 |

Vulcanizing conditions: initial semi-vulcanization at relatively low temperature 120±10° C. for 5 to 10 minutes, followed by vulcanization at 150±10° C. for 5 to 20 minutes.

It is recommended that in rubber compositions for core layers, the amount of zinc oxide be at least 10%, more preferably at least 20%, most preferably at least 50% by weight of the total weight of inorganic fillers (inclusive of zinc oxide).

From the rubber composition, the core inner layer may be molded by any desired method. For example, the rubber composition for the inner layer is kneaded in a conventional kneader such as a Banbury mixer or roll mill and molded in a core mold.

The core inner layer (or inner sphere) formed as described above should have a diameter of 15 to 22 mm, and preferably 17 to 22 mm. An-inner core diameter of less than 15 mm is accompanied by a greater proportion of the soft core outer layer, leading to lower resilience. With a diameter in excess of 22 mm, the proportion of the soft core outer layer is too small to accommodate the conditions for head speeds of 35 to 40 m/s, failing to provide sufficient deformation and hence, flight performance.

The Shore D hardness of the core inner layer is in the range from 40 to 70, and preferably from 45 to 65. The core inner layer with a Shore D hardness of less than 40 is too soft to concentrate deformation in the core outer layer, failing to improve the carry. The core inner layer with a Shore D hardness of more than 70 is too hard so that the feel of the ball becomes hard and the ball will sky, resulting in a shorter carry. The core inner layer is preferably adjusted to a specific gravity of 1.1 to 1.65, more preferably 1.2 to 1.55.

The core outer layer 4 enclosing the core inner layer 3 is preferably formed to a lower hardness than the core inner layer. The core outer layer has a JIS-C hardness in the range of from 40 to 75, and preferably from 50 to 70. The core outer layer with a JIS-C hardness of less than 40 is too soft to provide resilience whereas the core outer layer with a JIS-C hardness of more than 70 is too hard to be deformed. The Shore D hardness of the core outer layer is in the range from 25 to 55, preferably from 28 to 53, more preferably from 32 to 49.

With respect to the diameter and weight of the core outer layer, that is, the diameter and weight of the solid core, the diameter is preferably 36.5 to 41.5 mm, more preferably 38.5 to 41.5 mm and the weight is usually about 30.5 to 42.8 g. The core outer layer is preferably adjusted to a specific gravity of 1.05 to 1.25, more preferably 1.05 to 1.2.

The core outer layer 4 may be produced by molding and vulcanizing or curing the corresponding rubber composition in a known manner. For example, advantageous use may be made of a method in which vulcanization is divided into two steps. In the first step, the core outer layer material is placed in a core outer layer-forming mold and subjected to primary vulcanization (semi-vulcanization), thereby producing a pair of hemispherical half-cups. Next, a pre-formed core inner layer is placed in one of the hemi-spherical half-cups, the other half-cup is closed over this, and secondary vulcanization (full vulcanization) is carried out. That is, the solid core is completed at the same time as the formation of the core outer layer. Also a method of injection molding the core outer layer material over the preformed core inner layer is suitable.

According to the present invention, the cover 2 is formed to enclose the above-described solid core 1. The cover 2 may be formed of known cover materials. For example, ionomer resins and balata rubber are useful as well as thermoplastic elastomers such as polyurethane, polyamide, and polyester elastomers, with the ionomer resins being especially preferred. The cover may be formed over the core by conventional processes, for example, a compression molding process of preforming a cover stock into a pair of half cups, encasing the core in the half cups and effecting compression molding under predetermined heat and pressure conditions or an injection molding process of injection molding a kneaded cover stock around the core.

The cover has a gage (or radial thickness) of 0.5 to 3 mm, and preferably 1 to 2 mm. A cover gage of less than 0.5 mm is insufficient to provide durability whereas a cover gage in excess of 3 mm detracts from resilience. The cover preferably has a Shore D hardness in the range of 50 to 65, and more preferably 55 to 65. A specific gravity of about 0.95 to 1.25 is advantageous. As noted earlier, the cover may have a multilayer construction.

The solid golf ball formed as described above preferably has a deformation of 2.4 to 3.8 mm, and especially 2.6 to 3.5 mm, when a load of 100 kg is applied. The solid golf ball of the invention may be formed so as to have a diameter of not less than 42.67 mm and a weight of not greater than 45.93 g in accordance with the Rules of Golf.

As in conventional golf balls, the golf ball of the invention has a plurality of dimples formed on the surface of the cover.

The total number of dimples is preferably from 350 to 500, more preferably from 370 to 480, and even more preferably from 390 to 450. Dimples may be provided so that the dimple surface coverage, which is defined as the surface area of ball occupied by dimples divided by the total surface area of imaginary ball and expressed as a percentage, is 65% or more, and preferably 70 to 80%. The dimple volume ratio, which is defined as the total volume of dimples divided by the volume of imaginary ball and expressed as a percentage, may be set at 0.76 to 1.0%, and preferably 0.78 to 0.94%.

Being constructed as above, the solid golf ball of the invention is best suited for relatively low head speed players with a club head speed of less than 40 m/s, especially 35 to 40 m/s, for example, women, seniors and beginners. Even when such a player plays a full shot with a driver, the ball provides an increased carry and a pleasant feel.

EXAMPLE

Examples of the invention are given below by way of illustration and are not intended to limit the invention.

Examples 1–4 and Comparative Examples 1–3

The rubber compositions for the core inner layer shown in Table 1 were kneaded and molded and vulcanized in a mold at 155° C. for about 20 minutes to produce core inner layers (or inner spheres) having the parameters indicated in Table 3.

The rubber compositions for the core outer layer shown in Table 2 were kneaded in a roll mill, then molded and subjected to primary vulcanization (semi-vulcanization) in a mold at 120° C. for 6 minutes to form a pair of hemispherical half-cups. The core inner layer was enclosed within the resulting pair of hemispherical half-cups, which were subjected to secondary vulcanization (full vulcanization) within a mold at 155° C. for 15 minutes, thereby giving a solid core having a two-layer construction.

The cover stock described below was injection molded about the respective solid cores to form a cover having a gage of 2.0 mm and 392 dimples (with a dimple surface coverage of 78% and a dimple volume ratio of 0.88%), thereby giving solid golf balls having the properties shown in Table 3.

| Cover Stock: | Parts by weight |
|---|---|
| Ionomer resin A | 50.0 |
| Ionomer resin B | 50.0 |
| Titanium oxide | 5.0 |
| Dispersant and pigment | 1.2 |
| Shore D hardness | 61 |

It is noted that Ionomer resin A is Himilan 1605 (Mitsui-DuPont Polychemicals K.K.) and Ionomer resin B is Himilan 1706 (Mitsui-DuPont Polychemicals K.K.).

The golf balls thus obtained were evaluated as described below. The results are given in Table 3.

Flight Performance

The golf balls were measured for initial velocity, angle of elevation, carry, and total distance when hit with a driver (J's Metal, loft angle 11°, Bridgestone Sports Co., Ltd., W#1) at head speeds of 35 m/s (HS35), 40 m/s (HS40), and 45 m/s (HS45) using a swing robot.

Feel

With a driver, three male golfers who swung at a club head speed of about 40 m/s (HS40) and three female golfers who swung at a head speed of about 35 m/s (HS35) actually hit the balls. The golfers evaluated the feel of each ball with ratings of "Good," "Fair" and "Poor."

TABLE 1

| Core inner layer | A | B | C | D |
|---|---|---|---|---|
| JSR BR01[1)] | 100.00 | 100.00 | 100.00 | 100.00 |
| Zinc oxide | 10.00 | 10.00 | 10.00 | 10.00 |
| Zinc acrylate | 30.00 | 40.00 | 40.00 | 30.00 |
| Barium sulfate | 64.82 | 62.40 | 11.37 | 15.60 |
| Percumyl D[2)] | 1.20 | 1.20 | 1.20 | 1.20 |
| Blend specific gravity | 1.42 | 1.42 | 1.17 | 1.17 |

[1)]cis-1,4-polybutadiene by Japan Synthetic Rubber K.K.

[2)]peroxide by Nippon Fats & Oil K.K.

TABLE 2

| Core outer layer | E | F | G | H | I | J |
|---|---|---|---|---|---|---|
| JSR BR11[1)] | 50.00 | 50.00 | 50.00 | 50.00 | 50.00 | 50.00 |
| JSR BR18[1)] | 50.00 | 50.00 | 50.00 | 50.00 | 50.00 | 50.00 |
| Zinc oxide | 10.00 | 10.00 | 10.00 | 10.00 | 10.00 | 10.00 |
| Zinc acrylate | 25.00 | 20.00 | 25.00 | 20.00 | 28.00 | 25.00 |
| Barium sulfate | 8.53 | 7.44 | 5.10 | 12.52 | 8.92 | 10.27 |
| Antioxidant[3)] | 0.20 | 0.20 | 0.20 | 0.20 | 0.20 | 0.20 |
| Percumyl D[2)] | 0.40 | 0.40 | 0.40 | 0.40 | 0.40 | 0.40 |
| Perhexa 3M[2)] | 0.80 | 0.80 | 0.80 | 0.80 | 0.80 | 0.80 |
| Blend specific gravity | 1.12 | 1.10 | 1.10 | 1.13 | 1.13 | 1.13 |

[1)]cis-1,4-polybutadiene by Japan Synthetic Rubber K.K.

[2)]peroxide by Nippon Fats & Oil K.K.

[3)]Nocrack NS-6 by Ouchi Shinko Chemical K.K.

TABLE 3

| | Example | | | | Comparative Example | | |
|---|---|---|---|---|---|---|---|
| | 1 | 2 | 3 | 4 | 1 | 2 | 3 |
| Core inner layer | | | | | | | |
| Blend | A | A | B | C | A | D | D |
| Outer diameter (mm) | 16.2 | 20.8 | 20.8 | 20.8 | 13.9 | 24.1 | 26.2 |
| Weight (g) | 3.2 | 6.8 | 6.8 | 5.7 | 2.0 | 8.8 | 11.3 |
| Specific gravity | 1.450 | 1.450 | 1.450 | 1.200 | 1.450 | 1.200 | 1.200 |
| Shore D hardness | 48 | 48 | 59 | 59 | 48 | 48 | 48 |
| Core outer layer | | | | | | | |
| Blend | E | F | G | H | I | J | J |
| Outer diameter (mm) | 38.6 | 38.6 | 38.6 | 38.6 | 38.6 | 38.6 | 38.6 |
| Weight (g) | 35.1 | 35.2 | 35.2 | 35.0 | 35.2 | 35.1 | 35.2 |
| Specific gravity | 1.141 | 1.115 | 1.115 | 1.153 | 1.153 | 1.152 | 1.152 |
| Shore D hardness | 43 | 34 | 43 | 34 | 45 | 43 | 43 |
| JIS-C hardness | 68 | 56 | 68 | 56 | 75 | 68 | 68 |
| Cover | | | | | | | |
| Shore D hardness | 61 | 61 | 61 | 61 | 61 | 61 | 61 |
| Gage (mm) | 2.0 | 2.0 | 2.0 | 2.0 | 2.0 | 2.0 | 2.0 |
| Product ball | | | | | | | |
| Outer diameter (mm) | 42.7 | 42.7 | 42.7 | 42.7 | 42.7 | 42.7 | 42.7 |
| Weight (g) | 45.3 | 45.4 | 45.4 | 45.2 | 45.4 | 45.3 | 45.4 |
| Hardness (mm) | 3.21 | 4.11 | 3.15 | 3.85 | 2.87 | 3.20 | 2.58 |
| W#1/HS35 | | | | | | | |
| Initial velocity (m/s) | 49.2 | 49.3 | 49.3 | 49.4 | 48.8 | 48.9 | 48.7 |
| Elevation angle (°) | 12.8 | 12.7 | 12.8 | 12.8 | 12.6 | 12.5 | 12.7 |
| Carry (m) | 136.4 | 137.8 | 138.1 | 138.9 | 134.3 | 134.7 | 133.5 |
| Total (m) | 147.6 | 148.9 | 150.4 | 152.0 | 142.9 | 142.8 | 140.3 |

TABLE 3-continued

| | Example | | | | Comparative Example | | |
|---|---|---|---|---|---|---|---|
| | 1 | 2 | 3 | 4 | 1 | 2 | 3 |
| W#1/HS40 | | | | | | | |
| Initial velocity (m/s) | 60.0 | 59.9 | 60.1 | 59.9 | 59.6 | 59.7 | 59.6 |
| Elevation angle (°) | 11.8 | 11.7 | 12.0 | 11.7 | 11.8 | 12.1 | 12.3 |
| Carry (m) | 184.4 | 182.0 | 185.7 | 183.4 | 180.9 | 185.4 | 186.5 |
| Total (m) | 198.2 | 198.0 | 199.4 | 197.5 | 195.2 | 196.2 | 195.7 |
| W#1/HS45 | | | | | | | |
| Initial velocity (m/s) | 67.1 | 66.9 | 67.3 | 66.8 | 66.6 | 66.7 | 67.3 |
| Elevation angle (°) | 11.7 | 11.7 | 12.0 | 11.8 | 11.7 | 12.1 | 12.3 |
| Carry (m) | 215.9 | 216.5 | 217.6 | 215.0 | 215.8 | 217.0 | 216.7 |
| Total (m) | 230.7 | 229.3 | 230.4 | 229.8 | 229.7 | 230.3 | 229.2 |
| Feel | | | | | | | |
| HS35 | Good | Good | Good | Good | Fair | Fair | Poor |
| HS40 | Good | Fair | Good | Fair | Fair | Poor | Poor |

It is noted that the weight of the core outer layer is the weight of the solid core (inner layer plus outer layer) and the hardness of the ball is expressed by a deformation (mm) under a load of 100 kg.

As seen from Table 3, the ball of Comparative Example 1 shows inferior flight performance at head speeds of 35 and 40 m/s because the core inner layer has a smaller diameter of 13.9 mm and hence, the relatively soft core outer layer occupies a greater proportion. The balls of Comparative Examples 2 and 3, which are of the same type as JP-A 23069/1994, show equivalent or better flight performance at a head speed of 45 m/s, but inferior flight performance at lower head speeds of 35 and 40 m/s, as compared with the balls of Examples 1 to 4.

In contrast, the balls of Examples 1 to 4 were found to show superior flight performance and a good feel when hit at head speeds of 45 to 35 m/s, especially 40 m/s or lower.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A three-piece solid golf ball comprising;

a solid core and a cover enclosing the solid core, said solid core having a two-piece construction consisting of a core inner layer and a core outer layer enclosing the core inner layer, wherein said core inner layer has a diameter of 15 to 22 mm and a Shore D hardness of 40 to 70 and a specific gravity of 1.1 to 1.65, said core outer layer has a JIS-C hardness in the range of 40 to 75, and a specific gravity of 1.05 to 1.25, wherein said specific gravity of said core inner layer is greater than said specific gravity of said core outer layer, each of said core inner layer and said core outer layer is formed of a polybutadiene base rubber composition, and said cover has a gage of 0.5 to 3 mm and a specific gravity of about 0.95 to 1.25.

2. The solid golf ball of claim 1 having a deformation of 2.4 to 3.8 mm under a load of 100 kg.

3. The solid golf ball of claim 1, wherein said core inner layer has a diameter of 17 to 22 mm.

4. The solid golf ball of claim 1, wherein the Shore D hardness or the core inner layer is in the range of 45 to 65.

5. The solid golf ball of claim 1, wherein said core inner layer has a specific gravity of 1.2 to 1.55.

6. The solid golf ball of claim 1, wherein said core outer layer has a JIS-C hardness of 50 to 70.

7. The solid golf ball of claim 1, wherein said core outer layer has a Shore D hardness of 32 to 49.

8. The solid golf ball of claim 1, wherein said solid core has a diameter of 38.5 to 41.5 mm.

9. The solid golf ball of claim 1, wherein said solid core has a weight of about 30.5 to 42.8 g.

10. The solid golf ball of claim 1, wherein said core outer layer has a specific gravity of 1.05 to 1.2.

11. The solid golf ball of claim 1, wherein said cover has a gauge of 1–2 mm.

12. The solid golf ball of claim 1, wherein said cover has a Shore D hardness of 55 to 65.

* * * * *